US007121835B2

(12) United States Patent
Silva

(10) Patent No.: US 7,121,835 B2
(45) Date of Patent: Oct. 17, 2006

(54) CONTACT SPRING ASSEMBLY, ESPECIALLY FOR AN ANTENNA AMPLIFIER

(75) Inventor: David Silva, Nürtingen (DE)

(73) Assignee: Hirschmann Electronics GmbH & Co. KG, Neckartenzlingen (DE)

( * ) Notice: Subject to any disclaimer, the term of this patent is extended or adjusted under 35 U.S.C. 154(b) by 0 days.

(21) Appl. No.: 10/960,429

(22) Filed: Oct. 6, 2004

(65) Prior Publication Data

US 2005/0090158 A1 Apr. 28, 2005

(30) Foreign Application Priority Data

Oct. 10, 2003 (DE) ..... 103 47 917
Mar. 10, 2004 (DE) ..... 10 2004 011 601

(51) Int. Cl.
*H01R 41/00* (2006.01)

(52) U.S. Cl. ..... 439/33; 439/630

(58) Field of Classification Search ..... 439/33, 439/630, 660, 733.1, 500, 59, 66, 862, 701, 439/626, 736, 1, 32; 343/713, 906, 711–712, 343/870

See application file for complete search history.

(56) References Cited

U.S. PATENT DOCUMENTS

| | | | | |
|---|---|---|---|---|
| 5,730,619 | A | 3/1998 | Hamlin | |
| 5,975,959 | A | 11/1999 | Joly | |
| 6,398,598 | B1 * | 6/2002 | Masumoto | 439/862 |
| 6,411,259 | B1 * | 6/2002 | Wendt et al. | 343/713 |
| 6,702,621 | B1 * | 3/2004 | Yeh | 439/660 |
| 6,903,698 | B1 * | 6/2005 | Silva | 343/713 |

FOREIGN PATENT DOCUMENTS

DE 102 58 101 4/2004

* cited by examiner

*Primary Examiner*—Truc T. Nguyen
*Assistant Examiner*—Edwin A. Leon
(74) *Attorney, Agent, or Firm*—Andrew Wilford

(57) ABSTRACT

A contact spring assembly has a contact plate with a window in which a contact spring is received, the contact spring having bent strips engageable with an antenna amplifier and an antenna amplifier structure. The contact spring is fixed at one end and movable at its other end on the support plate.

18 Claims, 2 Drawing Sheets

CONTACT SPRING ASSEMBLY, ESPECIALLY FOR AN ANTENNA AMPLIFIER

FIELD OF THE INVENTION

My present invention relates to a contact spring assembly, especially for an antenna amplifier and, more particularly, to a contact spring assembly adapted to be provided between two members between which an electrical contact is to be established, for example, a contact location on a vehicle body and an antenna amplifier to be electrically connected to that contact location.

BACKGROUND OF THE INVENTION

In my commonly-assigned copending application Ser. No. 10/721,921 filed 10 Dec. 2003 and corresponding to German application DE 102 58 101 and the corresponding patent DE 102 58 101 B1, a contact spring is described for an antenna unit adapted to be mounted upon a vehicle body in which a carrier or support plate receives at least one contact spring and the antenna amplifier bears against a bent portion of the contact spring forming one contact surface. In the system of DE 102 58 101, the carrier plate is provided between a window pane of the vehicle body which may have contact locations connected with an antenna applied to that window pane and an electronic device which can be an antenna amplifier or the housing thereof.

The support plate has a cutout in which a contact spring is arranged with a particular configuration, for example, the shape of a loop having inwardly bent ends and a bight between those ends. The two ends can be pressed together in mounting the contact spring in the support plate so that they overlap, i.e. one of the bent ends is a gauge in the other. The advantage of this configuration is that the contact spring is trapped on the support plate and can be easily mounted thereon, can have the requisite resilience in mounting the antenna amplifier on the vehicle window pane, and can provide a problem-free reliable and convenient electrical contact between the electronic device and the antenna. While this construction has proved to be successful in practice, it does have a drawback in that it is difficult to mount the contact spring on the support plate automatically and thus to automate the formation of the contact arrangement. It has been found to be necessary to utilize manual assembly techniques. Another drawback is that the precision of the position of the contact spring leaves something to be desired since the contact spring can move with considerable latitude around the rib about which the contact spring fits.

OBJECTS OF THE INVENTION

It is therefore the principal object of the present invention to provide an improved contact spring assembly whereby the aforementioned drawbacks can be eliminated, and an electrical contact can be formed between the electronic device and another member, e.g. a window of a vehicle provided with an antenna, in a more reliable and precise manner.

Another object of this invention is to provide a contact spring assembly which can be fabricated more easily and especially by automation.

Still another object of this invention is to provide an improved contact spring assembly, especially for use with an automotive antenna amplifier, whereby drawbacks of earlier systems are avoided and the mounting of the contact spring assembly is facilitated.

SUMMARY OF THE INVENTION

These object are achieved, in accordance with the invention in a contact spring assembly for making an electrical contact between two members, especially an antenna amplifier and a contact point on a vehicle body portion, such as a window of a vehicle provided with a contact point for an antenna. The assembly comprises:

a support plate located between the members and having a window;

a contact spring on the support plate formed with at least one bend region projecting toward and engageable with each of the members, whereby bend regions of the contact spring extend in opposite directions toward the members; and an attachment at one side of the contact spring fixing the contact spring to the support plate.

Preferably the support plate is formed with a support for an opposite side of the contact spring enabling movement of the contact spring at least in a plane thereof.

The support can be a slit formed in the support plate and movably receiving the contact spring.

The contact spring itself may be a planar sheet of spring metal provided with a multiplicity of parallel strips which may be bent alternatively in opposite directions to engage one or the other of the members.

At the one side of the contact spring the support plate is formed with at least one first element and the contact spring is formed with at least one second element mating with the first element to form the attachment or the contact spring can be adhesively bonded with the support plate to form the attachment.

According to the invention, therefore, the contact spring has at least one bent portion turned toward each of the contact locations, e.g. the antenna amplifier and the window provided with the antenna contacts, and has only one of its sides fixed to the support plate while the other side, i.e. on the opposite side from the fixed portion across the bend region, movable but supported on that support plate. With this configuration, the contact spring is fixed with respect to the support plate and thus has a defined region of contact with each of the members while the freely movable end or side lets the bend region compress as may be required between the two members. The bend regions can then fill or match the spacing between the members and the contact regions can lie between the two planes of contact with great precision as to the actual locations of contact and so that the contact will again be made if the system must be disassembled and reassembled.

The fact that the movable side of the contact spring rests upon a supporting surface of the plate and is guided in a slit therein also has the advantage of providing a reliable and precise positioning of the contact location by preventing nonuniform bending of the contact spring. The fixing of one side and the movable mounting of the other facilitates automated assembly of the contact spring with the support plate and prevents straining of the contact spring between fixed supports.

The contact spring itself can be a stamped sheet spring metal member formed in the bend regions with parallel slits separating the bend portions from one another so that the bent portion can be deformed alternately in bows to opposite sides, for example, by shoving the ends of the compact spring toward one another in the length.

The contact spring can also be fabricated from a planar metal member which is given at least in the bend region a corrugated shape so that at least one crest projects toward each of the two members sandwiching the assembly between them. The contact spring can be affixed in a variety of ways to the support plate at the fixed side and guided on the support plate on the opposite side in any desirable fashion. By the configuration of the bent region, its length, width, thickness and shape the desirable spring characteristics can be provided and widened or narrowed regions can be formed along the contact strips to impart desired spring characteristics thereto.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
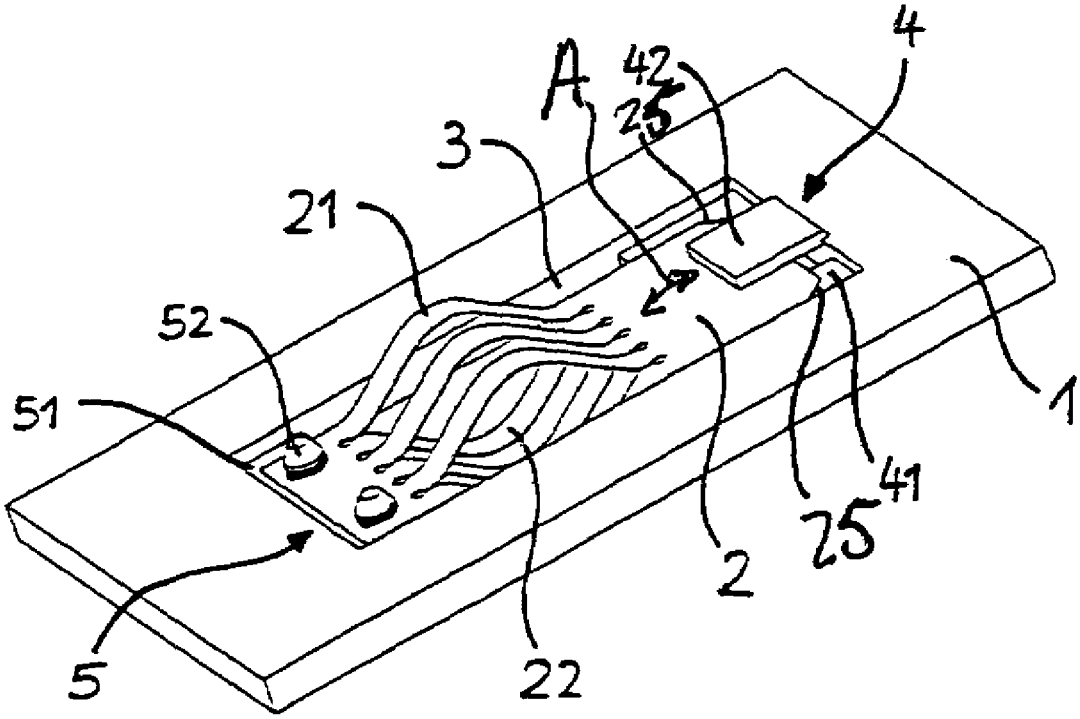
FIG. 1 is a perspective view of an assembly provided with a contact spring and a support plate according to the invention.

FIG. 1 shows, in a perspective view, a contact assembly which can be interposed between an electric circuit, for example, an antenna amplifier, and the antenna conductors which may be embedded in or applied to a windshield, rear window or other window pane of a vehicle body. The contact arrangement comprises a support plate 1 of plastic or other electrically insulating material on which is mounted a contact spring 2 which is located in a recess or window 3 of the carrier plate and has bent regions or strips which bulge upwardly (strips 21) alternating with contact strips 22 which bulge downwardly. The strips are separated from one another by slits in the sheet spring metal of the contact spring.

A preferred, but not necessarily limiting, field of application of the contact spring 2 is in automotive vehicle technology in which case the electric device can be an antenna amplifier or other signal processor which can be mounted on a window pane of the vehicle and can make electric contact between the device and especially its housing and corresponding contact locations on the window, for example, of the antenna conductor structure. If the electric device must be connected to the antenna structure at two or more contact locations, corresponding numbers of pairs, i.e. contact springs 2 are provided. The support plate 1 need not be a separate member as shown but can be part of say the cunderside of the housing of the electric device, a printed circuit board of the electronic device or the like.

The contact spring 2, as shown in FIG. 1, is affixed at one of its flat ends to the support plate 1 while the other end is received in a clamping region 4 between a ledge 41 and a holder 42 so that this end of the contact spring fits into the slit between elements 41 and 42 and can move freely in its longitudinal direction (arrow A) within this slit. The contact spring can be inserted into the slit by a robot and thus as part of the automated assembly of the contact arrangement to facilitate insertion into the slit, bevels are provided at 25 at the end of the contact spring.

The other free end of the contact spring 2 is fixed in the attachment region 5 to the support plate 1. This attachment region can have a ledge 51 upon which this free end of the contact spring 2 rests. The attachment means can included projections 52 which extend upwardly from the ledge 51 and engage in corresponding holes or bores 26 of the contact spring 2 as has been indicated for example in FIG. 4.

This configuration of the attachment means has the advantage that the projections 52 can be injection molded as part of the support plate.

Figure 2:
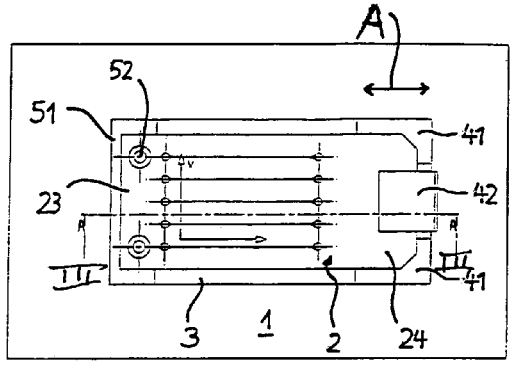
FIG. 2 is a plan view of the assembly.
Figure 5:
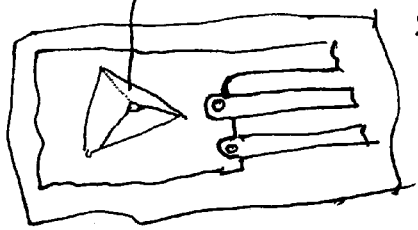
FIG. 5 shows a different cross sectional configuration for a pin.
Figure 4:
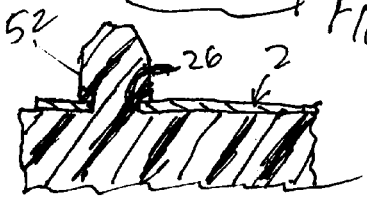
FIG. 4 is a detail section showing a pin traversing a hole in the contact spring in an alternative embodiment.

The free end of each projection 52 is tapered at 53 to facilitate insertion in the hole and enables the hole to be searched over the projection. In FIG. 4, the projection 52 has been deformed to overhang the contact spring 2 around the hole 26. The projection 52 need not be circular as shown but can have a triangular configuration as indicated at 54 in FIG. 5 or a rectangular configuration as shown at 55. The projection in each case is formed in one piece with the support plate 1 of plastic. FIG. 2 shows the support plate 1 with the contact spring 2 in place and from this view, it will be apparent that one end 23 of the contact spring rests upon the ledge 51 while the other end 54 of the contact spring rests upon the ledge 41.

The slit between members 41 and 42 is here shown at 43.

Figure 3:
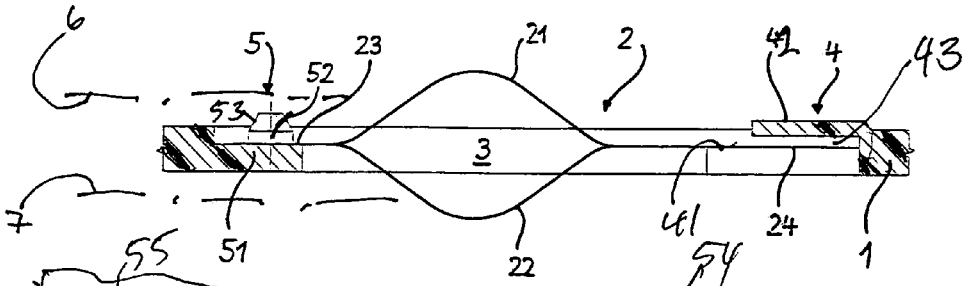
FIG. 3 is a cross sectional view taken along the line III—III of FIG. 2 and drawn to a larger scale.
Figure 6:
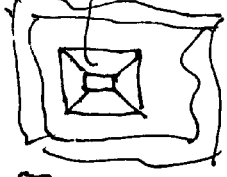
FIG. 6 illustrates another embodiment.

FIG. 3 is a section through the support plate 1 and the contact spring 2 showing the bode regions 21 and 22 in greater detail. In this figure, the bottom of the antenna amplifier has been represented by the plane 6 and the top of the antenna conductor structure by the plane 7, which sandwich the contact spring bends 21 and 22 between them. The ledges 41 and 52 can extend over substantially the full widths of the contact springs and are set below the upper surface of the support plate. The ends 33 of the contact spring, however, need not be supported by such a ledge but may rest upon the upper surface of the support plate. That construction may also be provided for the contact spring end 24. The assembly can be easily formed and the mounting tolerances can be accommodated by the mobility in the direction of arrow A. The length of the contact spring 2 should be so selected that even with full elongation, the contact spring does not abut any of the edges of the window 3.

I claim:

1. A contact spring assembly for making an electrical contact between two members, said assembly comprising:

a support plate located between said members and having a window;

a one-piece sheet-metal contact spring on said support plate formed with two spaced, flat, and coplanar end regions flanking the window and at least two oppositely bowed bend regions extending across the window between and unitary with the end regions and projecting toward and engageable with said members, the bend regions of the contact spring extending in opposite directions toward said members;

an attachment at one side of said contact spring fixing one of the end regions of said contact spring to said support plate; and means including a support at the opposite side of the contact spring for receiving the other of the end regions and enabling movement of the other end region generally only in a plane of the end regions as the bend regions are elastically deformed.

2. The contact spring assembly defined in claim 1 wherein said contact spring is a stamping of spring metal in which a plurality of parallel slits are punched to separate respective bend regions from one another, said bend regions being bent alternately to opposite sides.

3. The contact spring assembly defined in claim 1 wherein said support is a slit formed in said support plate and movably receiving the other end region of said contact spring.

4. The contact spring assembly defined in claim 3 wherein at said one side of said contact spring, said support plate is formed with at least one first element and said contact spring is formed with at least one second element mating with said first element to form said attachment, or said contact spring is adhesively bonded to said support plate to form said attachment.

5. The contact spring assembly defined in claim 4 wherein one of said elements is a hole and the other of said elements is a projection fitting in said hole.

6. The contact spring assembly defined in claim 5 wherein said projection is deformable to anchor said contact spring on said support plate.

7. The contact spring assembly defined in claim 5 wherein said projection has a polygonal cross section.

8. The contact spring assembly defined in claim 5 wherein said hole is formed in said contact spring and said projection is formed on said support plate.

9. The contact spring assembly defined in claim 8 wherein said support plate is formed at said one side with a ledge set back from a surface of said support plate, said one side of said contact spring resting upon said ledge, said projection being formed on said ledge.

10. The contact spring assembly defined in claim 9 wherein said projection is formed with a tapered end facilitating insertion through said hole.

11. The contact spring assembly defined in claim 1 and interposed between an antenna amplifier forming one of said members and a contact location on a window of an automobile, and wherein at said one side of said contact spring, said support plate is formed with at least one first element and said contact spring is formed with at least one second element mating with said first element to form said attachment, or said contact spring is adhesively bonded to said support plate to form said attachment.

12. The contact spring assembly defined in claim 11 wherein said projection is deformable to anchor said contact spring on said support plate.

13. The contact spring assembly defined in claim 11 wherein said projection has a polygonal cross section.

14. The contact spring assembly defined in claim 11 wherein said contact spring is a stamping of spring metal in which a plurality of parallel slits are punched to separate respective bend regions from one another, said bend regions being bent alternately to opposite sides.

15. The contact spring assembly defined in claim 11 wherein one of said elements is a hole and the other of said elements is a projection fitting in said hole.

16. The contact spring assembly defined in claim 15 wherein said hole is formed in said contact spring and said projection is formed on said support plate.

17. The contact spring assembly defined in claim 16 wherein said support plate is formed at said one side with a ledge set back from a surface of said support plate, said one side of said contact spring resting upon said ledge, said projection being formed on said ledge.

18. The contact spring assembly defined in claim 17 wherein said projection is formed with a tapered end facilitating insertion through said hole.

* * * * *